US007698782B2

(12) United States Patent
Lautenschlager

(10) Patent No.: US 7,698,782 B2
(45) Date of Patent: Apr. 20, 2010

(54) FURNITURE HINGE

(75) Inventor: Horst Lautenschlager, Reinheim (DE)

(73) Assignee: Liberty Hardware Mfg. Corp., Winston-Salem, NC (US)

( * ) Notice: Subject to any disclaimer, the term of this patent is extended or adjusted under 35 U.S.C. 154(b) by 177 days.

(21) Appl. No.: 11/684,746

(22) Filed: Mar. 12, 2007

(65) Prior Publication Data

US 2007/0209156 A1 Sep. 13, 2007

(51) Int. Cl.
*E05D 7/04* (2006.01)

(52) U.S. Cl. ..... 16/242; 16/235; 16/236; 16/238; 16/245; 16/246

(58) Field of Classification Search ..... 16/242, 16/235, 236, 237, 238, 245, 246, 360, 361
See application file for complete search history.

(56) References Cited

U.S. PATENT DOCUMENTS 4,359,803 A * 11/1982 Lautenschlager ..... 16/272
4,509,229 A * 4/1985 Salice ..... 16/327
5,930,866 A * 8/1999 Rupprechter ..... 16/242
6,125,508 A * 10/2000 Formenti ..... 16/335
6,442,798 B1 * 9/2002 Rupprechter ..... 16/242
6,622,343 B2 * 9/2003 Rupprechter ..... 16/242
6,880,205 B2 * 4/2005 Rupprechter ..... 16/235
6,996,877 B2 * 2/2006 Booker et al. ..... 16/257
7,231,691 B1 * 6/2007 Domenig et al. ..... 16/236
2004/0006846 A1 * 1/2004 Rupprechter ..... 16/235
2005/0251961 A1 * 11/2005 Liu ..... 16/242

* cited by examiner

*Primary Examiner*—Victor Batson
*Assistant Examiner*—Jeffrey O'Brien
(74) *Attorney, Agent, or Firm*—Carlson, Gaskey & Olds PC

(57) ABSTRACT

An example furniture hinge includes a carrier arm, a door fitting having a recessed cup that is rotatably disposed on one end of the carrier arm, and an end plate adjustably connected to another end of the carrier arm. A mounting plate that attaches to a furniture body includes a wall portion. An eccentric element laterally adjustably attaches the end plate to the wall portion. The end plate includes an anchoring element for engaging behind the wall portion.

7 Claims, 3 Drawing Sheets

FURNITURE HINGE

This application claims priority to German Patent Application No. 10 2006 011 771.9 filed on Mar. 13, 2006.

BACKGROUND

This invention relates to a furniture hinge and, more particularly to a furniture hinge with a door fitting in the form of a recessed cup that is rotatably disposed on one end of a carrier arm and a fastening plate engaged on the other end of the arm that is adjustably attached and laterally adjustably attachable to a furniture body. An end plate of the carrier arm is laterally adjustably connected to a front wall of the fastening plate and is adjustable by using an eccentric component operating between the end plate and the front wall.

Some furniture hinges serve for rotatable attachment of a furniture door to a furniture body. To laterally adjust the furniture door in the horizontal direction along the front face of the furniture following assembly, a carrier arm laterally adjusts to move a front wall of a fastening plate. An eccentric component connects a carrier arm bearing, the furniture door, and the fastening plate which, for example, is rotatably disposed in the front wall and engages with its head across the edges of a slot in an end plate of the carrier arm.

Some known furniture hinges mount the eccentric component in the front wall such that the eccentric component is positively, yet rotatably, retained in a hole in the front wall by peening its mounting pin. Disadvantageously, such a mounting is not suitable for the transmission of strong forces.

Additionally, the eccentric component may not withstand heavy loads because of insufficient overlap between the eccentric component's head and the edges of the lateral slot.

If the furniture door is moved beyond an outer pivot position when opened, the forces arising as a consequence of the leverage in the area of the lateral adjustment member may tear the eccentric component from the front wall of the fastening plate or out of the lateral slot of the end plate of the carrier arm. Such a result may destroy the furniture hinge or otherwise render it unsable.

Some known furniture hinges include rails protruding from the two side flanges of the end of the carrier arm away from the hinge. The rails engage behind the lateral edges of the front wall of the fastening plate. In this way, the forces arising from a stress on the hinge can be transferred from the carrier arm to the front wall of the fastening plate. However, these opposed protruding rails are expensive to manufacture. Additionally, the lever arm between the gripping area of these rails and the active area of contact between the front wall and the carrier arm is relatively small so that the transfer bending moment is also small. Additionally, the rails extend only slightly behind the lateral edges of the front wall. Consequently, the lateral flanges can be spread under high loading.

The invention provides a furniture hinge which avoids overloading the lateral adjustment member of the carrier arm even when the furniture door is pivoted beyond a normal opening position.

SUMMARY OF THE INVENTION

An example furniture hinge includes a carrier arm, a door fitting having a recessed cup that is rotatably disposed on one end of the carrier arm, and an end plate adjustably connected to another end of the carrier arm. A mounting plate that attaches to a furniture body includes a wall portion. An eccentric element laterally adjustably attaches the end plate to the wall portion. The end plate includes an anchoring element for engaging behind the wall portion.

Another example furniture hinge includes an end plate of a carrier arm at the end farther from the hinge. The end plate includes an anchoring element that engages behind a front wall by virtue of its shape.

Such an example furniture hinge transfers a bending moment arising from overload in the region of the lateral adjustment member to the front wall of the fastening plate by tensile stress of the anchoring element on the outer end of the end plate of the carrier arm. The lateral adjustment member, and particularly the eccentric component, is not overly stressed by the increased bending moment arising and is thus not deformed, even if the outermost open position of the furniture hinge should be exceeded. Thus, in this example, there is no need for opposed protruding rails on the side flanges of the end plate of the carrier arm.

In another example embodiment, the anchoring element of the end plate includes an anchoring strip angled toward the front plate. The strip engages across the edge of the front wall and is angled toward the rear side of the front wall in the form of an anchoring tongue.

The anchoring element to transmit the force is thereby formed by bending the outer end of the carrier arm in a manner that is simple in both design and manufacture. At the same time this bent end forms a smooth closure for the end of the carrier arm so that it does not exhibit any sharp edges at this site.

In another example embodiment, the anchoring element of the end plate includes an angled anchoring strip which extends through a lateral slot in the edge of the front wall farther from the hinge and which exhibits an anchoring head engaging on the rear side of the front wall. The anchoring head can exhibit a hammer-head shape, for example, and engage on both sides behind the slot edges of the lateral slot. In this way a particularly compact and space-saving design of the furniture hinge in the region of the lateral adjustment member is achieved.

These and other features of the present invention can be best understood from the following specification and drawings, the following of which is a brief description.

DETAILED DESCRIPTION OF THE PREFERRED EMBODIMENT

Figure 1:
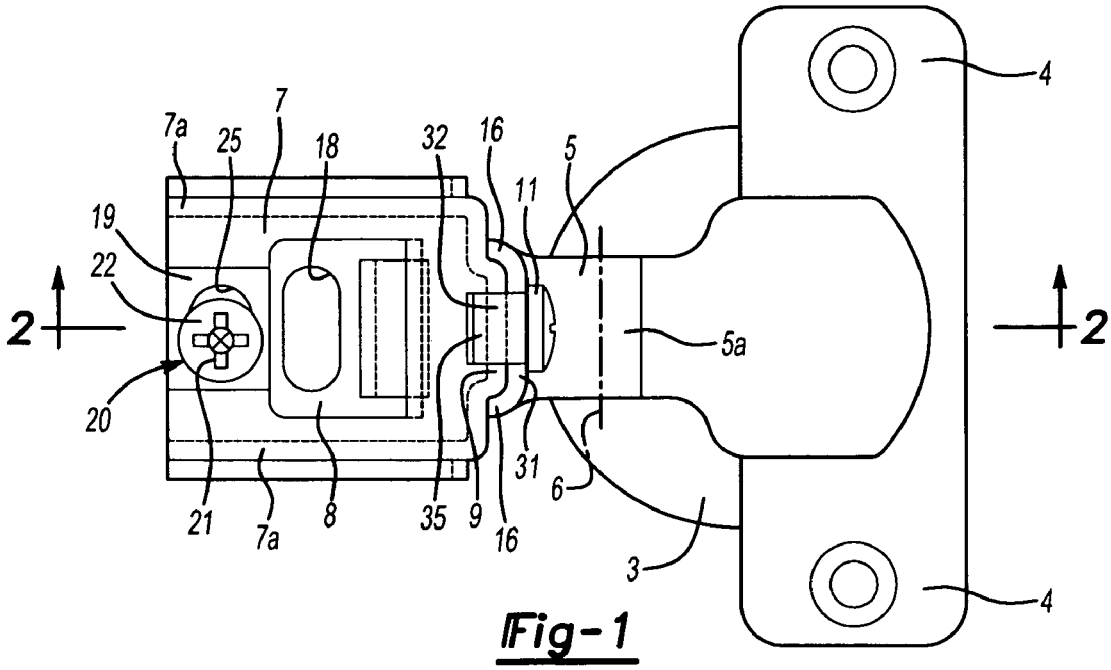
FIG. 1 shows a front view of a furniture hinge in an open state.
Figure 2:
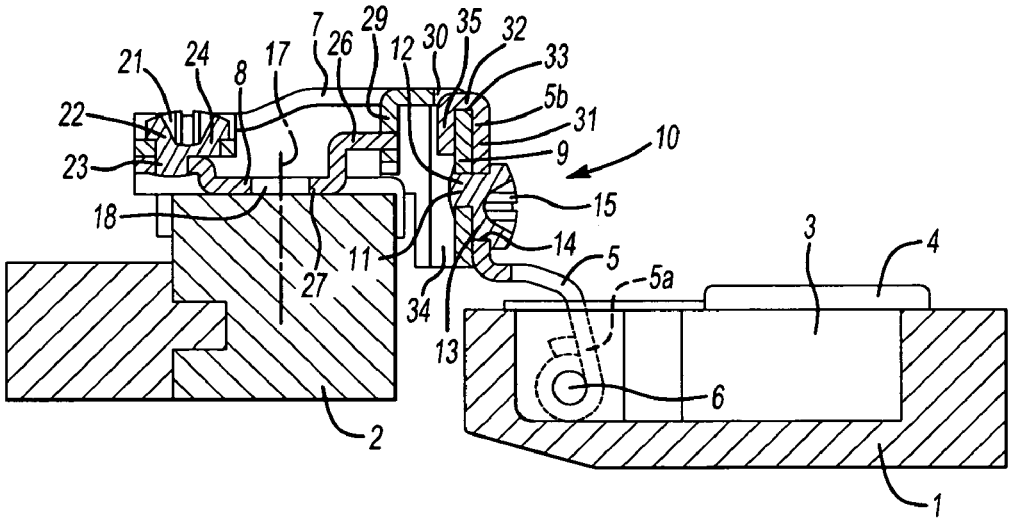
FIG. 2 shows a cross-sectional view along section line 2 of FIG. 1.

The furniture hinge shown in FIGS. 1 and 2 serves for the rotatable attachment of a furniture door 1 to a piece of furniture, for example, to a furniture front frame 2 of a piece of furniture of the "face-frame" design.

In this example, the furniture hinge exhibits a door fitting component in the form of a recessed cup 3 that is attached to the furniture door 1 by means of fastening screws (not shown) through side attachment ears 4.

Figure 3:
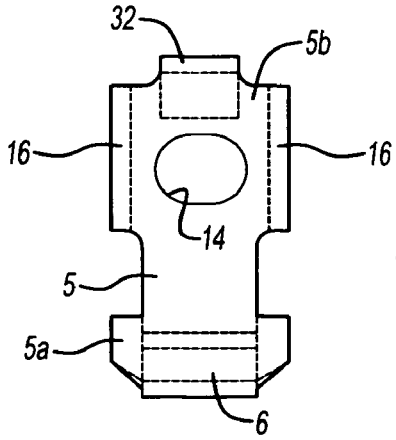
FIG. 3 shows a view of a carrier arm of a furniture hinge.
Figure 4:
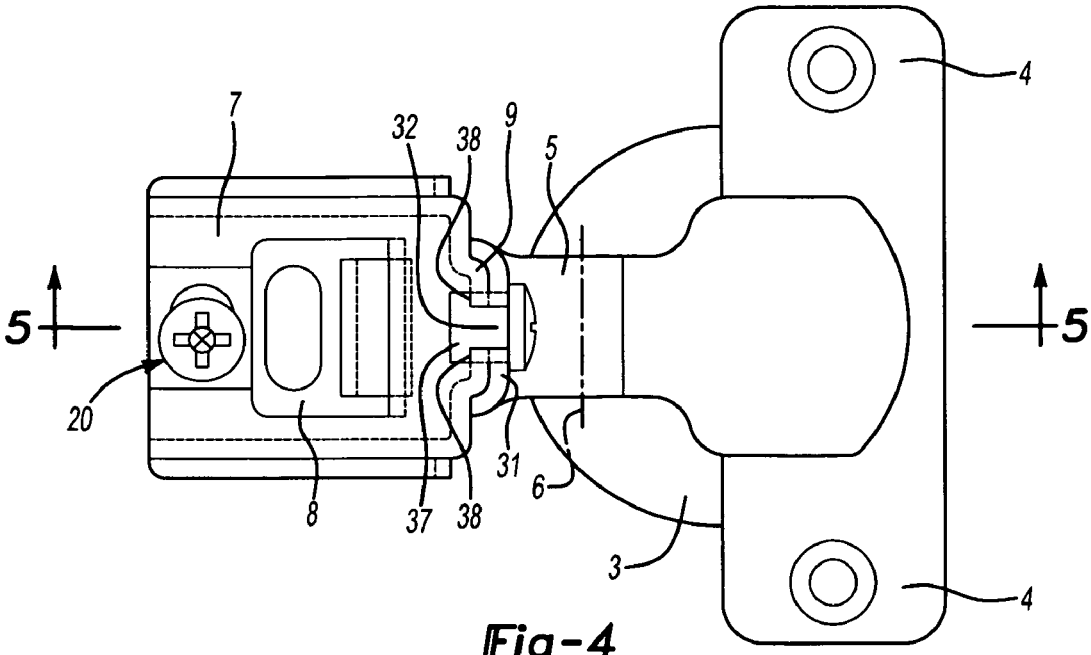
FIG. 4 shows a front view of another example furniture hinge.
Figure 5:
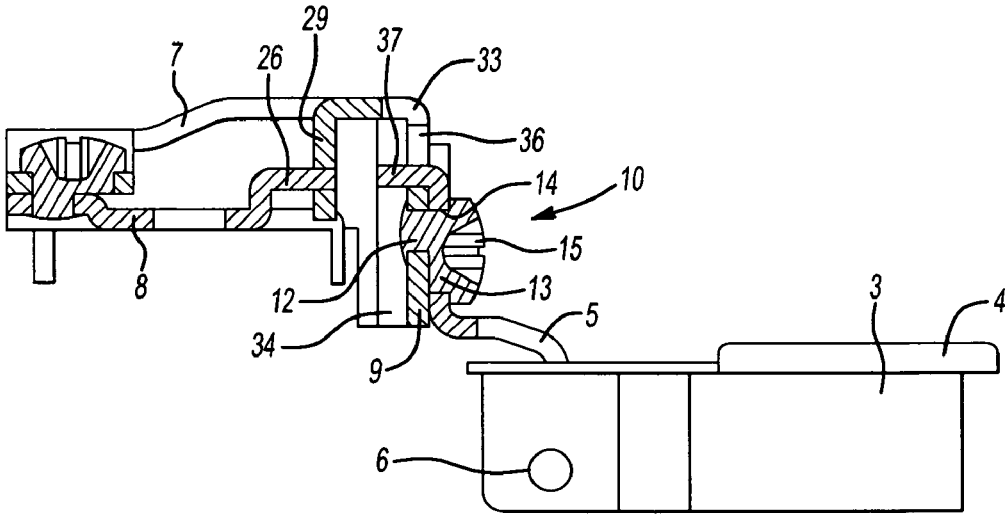
FIG. 5 a cross-section along section line 5 of FIG. 4.

The furniture hinge includes a carrier arm 5 formed from sheet metal as shown in FIG. 3. The carrier arm 5 attaches at one end 5*a*, the end toward the furniture door 1, to a pivoting hinge or linkage 6. The recessed cup 3 is rotatably disposed on the linkage 6 of the carrier arm 5.

A fastening plate 7 formed from sheet metal adjustably attaches to the other end 5*b* of the carrier arm 5. The fastening plate 7 further attaches to a mounting unit with a mounting plate 8 formed from sheet metal, which in the exemplary embodiment shown in FIG. 2 is screwed onto the front frame 2.

The other end of the carrier arm 5 (i.e. the end away from the furniture door 1) bears against a front wall 9 of the fastening plate 7. In this example, the front wall 9 is oriented perpendicular to the plane of the base of the fastening plate 7, and the mounting plate 8 adjustably attaches to the fastening plate 7 using a lateral adjustment member 10. The front wall 9 is oriented perpendicularly to the base plane of the fastening plate 7. An eccentric component 11 is rotatably disposed on the front wall 9 using a mounting pin 12. An eccentric section 13 of the eccentric component 11, eccentric with respect to the mounting pin 12, engages in a guide slot 14 of the carrier arm 5. The guide slot 14 extends perpendicular to the direction of adjustment. In this example, the eccentric component 11 can be adjusted using an adjusting tool including features for engaging, for example, a Philips screw head 15.

When the eccentric component 11 is turned, the carrier arm 5 is displaced along the front wall 9. An end 5*b* of the carrier arm 5, which is facing the front wall 9, includes lateral flanges 16 that straddle and guide the two side edges of the front wall 9. Thus, the lateral adjustment member 10 provides the benefit of lateral displacement of the furniture door 1 with respect to the furniture body.

The mounting plate 8 attaches to the front frame 2 using an attachment screw 17. Attachment screw 17 grips through an elongated hole 18 that extends perpendicular to the long dimension of the mounting plate 8 to permit height adjustment in attaching the mounting plate 8.

A cross-strip 19 in the fastening plate 7 connects to the mounting plate 8 using a lateral adjustment member 20. In this example, the lateral adjustment member 20 is designed similarly to the side adjustment member 10. That is, an eccentric component 22 is rotatably disposed on a mounting pin 23 and includes features 21 for engaging an adjusting tool, for example, a Philips screw head. An eccentric section 24 of the eccentric component 22 engages a transverse slot 25 in cross-strip 19. Turning the eccentric component 22 adjusts the lateral position of the fastening plate 7 (i.e., horizontally in FIG. 1) relative to the mounting plate 8, which is fixed to the piece of furniture. The fastening plate 7 grips the lateral edges of the mounting plate 8 by means of the edge flanges 7*a* and is thus guided in the lateral direction.

In the disclosed example, the door-end of the mounting plate 8 includes a guide tongue 26 extending parallel to the plane of the mounting plate 8 for guiding the fastening plate 7 on the mounting plate 8. The guide tongue is offset above the base plate 27 of the mounting plate 8. The guide tongue 26 engages into the guide slot 28, which is cut into the guide wall 29 and lies perpendicular to the plane of the fastening plate 7.

The guide wall 29 extends toward the mounting plate 8 from the upper wall 30 of the fastening plate 7, which is spaced from the base plate 27 of the mounting plate 8. The front wall 9 of the fastening plate 7 is parallel to and spaced from the guide slot 28 in the guide wall 29 of the fastening plate 7.

The carrier arm 5 includes an end plate 31 adjacent the front wall 9. The eccentric component 11 extends through the front wall 9 and is adjustable along the front wall 9. The lateral flanges 16 of the end plate 31 straddle the side edges of the front wall 9.

The end 5*b* positioned from the hinge of the end plate 31 of the carrier arm 5 includes an anchoring element that positively engages behind the front wall 9.

The anchoring element of the end plate 31 includes an anchoring strip 32 oriented toward the front plate 9, which, in this example, engages over an edge 33 on the front wall 9 and is bent down to form an anchoring flap 35 on a backside 34 of the front wall 9. The anchoring flap 35 extends substantially parallel to and is spaced from the end plate 31 to receive the thickness of the front wall 9. In such an example, substantially parallel refers to parallel within those tolerances common in the industry.

During a lateral adjustment by turning the eccentric element 11, the anchoring flap 35 moves along the backside 34 of the front wall 9.

The example furniture hinge of FIGS. 4-8 shows that the anchoring strip 32, which is bent out from the end plate 31 as an anchoring element, may extend through a longitudinal slot 36 in the front wall 9. The slot 36 is located on the front wall on the edge farther from the hinge, and the slot 36 extends in the direction of adjustment. An anchor head of the anchoring strip 32 engages the backside 34 of the front wall 9. The anchor head 37, in one example, is T-shaped or hammer-head shaped and engages the sides of the longitudinal slot 36.

Figure 6:
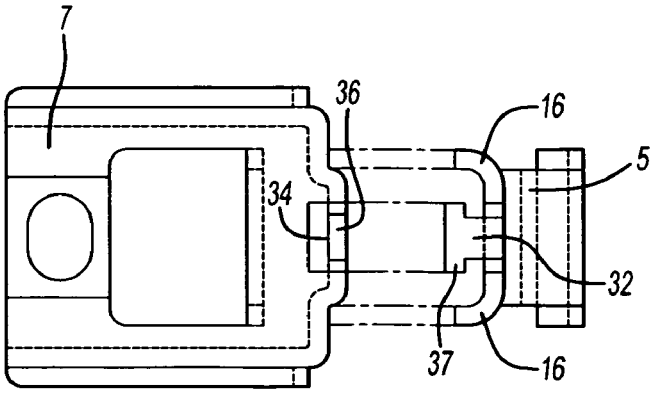
FIG. 6 shows a fastening plate and a carrier arm of a furniture hinge before assembly.
Figure 7:
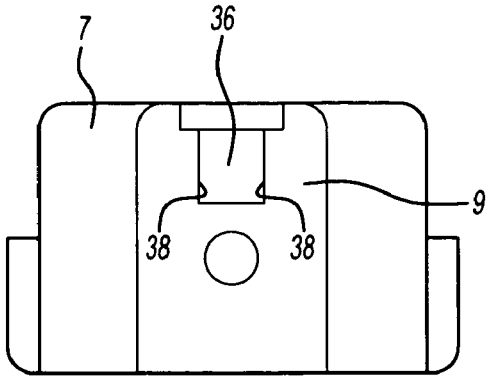
FIG. 7 shows another view of a mounting plate.
Figure 8:
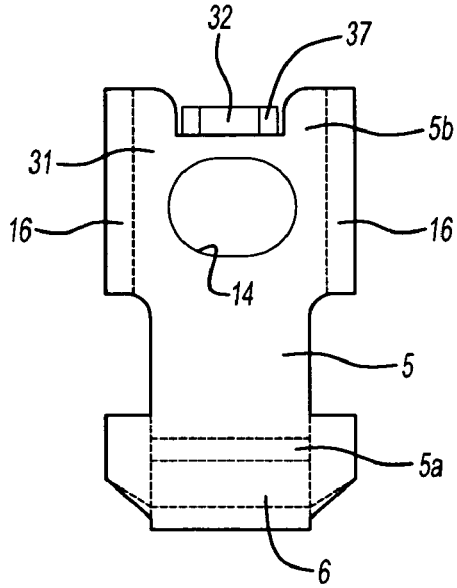
FIG. 8 shows another view of a carrier arm.

FIG. 6 shows the fastening plate 7 and the carrier arm 5 before assembly. FIG. 7 illustrates the longitudinal slot 36 in the front wall 9 of the fastening plate 7, which receives the anchoring element of the carrier arm 5 (FIG. 8) and engages the anchoring strip 32.

Figure 9:
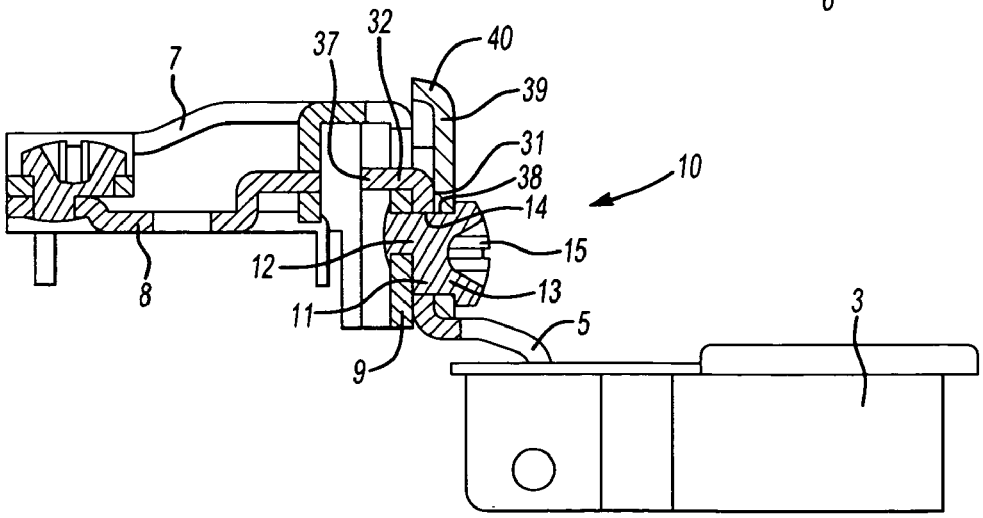
FIG. 9 shows another example cross-sectional view of a furniture hinge.

The example embodiment of a furniture hinge shown in the cross-sectional view of FIG. 9 illustrates that the end plate 31 of the carrier arm 5 may include a sheet-metal cap 39, which covers the front wall 9 through a range of adjustment. The sheet-metal cap 39 exhibits a bent edge 40 for this purpose. The eccentric element 11, held by the sheet-metal cap 39, extends through a slot 38 in the sheet-metal cap 39, and covers an area approximately equivalent in coverage to the underlying the guide slot 14 of the carrier arm 5.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

Although a preferred embodiment of this invention has been disclosed, a worker of ordinary skill in this art would recognize that certain modifications would come within the scope of this invention. For that reason, the following claims should be studied to determine the true scope and content of this invention.

I claim:

1. A furniture hinge comprising:

a carrier arm;

a door fitting having a recessed cup that is rotatably disposed at one end of the carrier arm;

a fastening plate adjustably connected to another end of the carrier arm, said fastening plate having a wall portion;

a mounting plate attachable to a furniture body; and an eccentric element laterally adjustably attaching the carrier arm to the wall portion of the fastening plate, wherein the carrier arm includes an anchoring element configured to engage an edge of the wall portion, the anchoring element bending around a bending axis substantially parallel to a rotational axis of the furniture hinge to engage the edge of the wall portion, wherein the anchoring element of the carrier arm includes an anchoring strip bounded by the wall portion, the anchoring strip having an anchoring flap lying adjacent the backside of the wall portion, wherein the anchoring flap is substantially parallel to and spaced apart from an end plate of the carrier arm at a distance substantially corresponding to a thickness of the wall portion.

2. The furniture hinge of claim 1, wherein the anchoring flap extends away from the other portions of the anchoring element in the direction of lateral adjustment.

3. The furniture hinge of claim 1, wherein the eccentric element includes an eccentric section whereby rotation of the eccentric section adjusts the position of the carrier arm relative to said fastening plate.

4. The furniture hinge of claim 3, further comprising a second eccentric element adjustably connecting said fastening plate to said mounting plate.

5. A furniture hinge comprising:

a carrier arm;

a door fitting having a recessed cup pivotably attached to a first end of said carrier arm;

a fastening plate adjustably connected to a second end of said carrier arm, said fastening plate having a wall portion;

a mounting plate attachable to a furniture body, said fastening plate adjustably mounted to said mounting plate; and an eccentric fastener laterally adjustably attaching said second end of said carrier arm to said wall portion of said fastening plate, wherein said carrier arm includes an end plate having an anchoring element bent around a bending axis substantially parallel to a rotational axis of the furniture hinge and establishing a channel configured to receive an edge of the wall portion that is aligned with a rotational axis of the furniture hinge, the anchoring element having an anchoring flap extending in the direction of lateral adjustment, the anchoring flap lying adjacent a backside of the wall portion when the edge of the wall portion is received within the channel, wherein said anchoring flap is substantially parallel to and spaced apart from said end plate of said carrier arm a distance substantially corresponding to a thickness of said wall portion.

6. The furniture hinge as defined in claim 5 further comprising a second eccentric fastener adjustably connecting said fastening plate to said mounting plate.

7. The furniture hinge as defined in claim 5 wherein said eccentric fastener includes an eccentric section whereby rotation of said eccentric section adjusts the position of said carrier arm relative to said fastening plate.

* * * * *